United States Patent [19]

Flick et al.

[11] Patent Number: 4,551,219

[45] Date of Patent: Nov. 5, 1985

[54] FLUSH EDGE PROTECTED METAL LAMINATES

[75] Inventors: Gary D. Flick, Pittsburgh; John H. Reinshagen, North Huntingdon, both of Pa.

[73] Assignee: Pfizer Inc., New York, N.Y.

[21] Appl. No.: 612,157

[22] Filed: May 21, 1984

[51] Int. Cl.[4] ..... C25B 11/00

[52] U.S. Cl. ..... 204/290 R; 204/290 F; 228/158; 29/455 LM; 29/746

[58] Field of Search ..... 204/290 R, 290 F, 292; 29/746, 509, DIG. 2, DIG. 32, DIG. 45, 455 LM; 219/81, 82, 83; 228/158

[56] References Cited

U.S. PATENT DOCUMENTS

| | | | |
|---|---|---|---|
| 2,833,003 | 5/1958 | Bourne | 29/455 LM |
| 3,054,176 | 9/1962 | Beneke | 228/158 |
| 3,443,055 | 5/1969 | Gwynn | 204/290 F |
| 3,711,937 | 1/1973 | Emley | 29/487 |
| 3,883,406 | 5/1975 | O'Brien et al. | 204/95 |
| 4,075,077 | 2/1978 | Hodges | 204/269 |
| 4,405,418 | 9/1983 | Takemura | 204/95 |

FOREIGN PATENT DOCUMENTS 996206 6/1965 United Kingdom .

OTHER PUBLICATIONS

J. E. Hughes, "Titanium and Zirconium Cladding", Sep. 1954, Metal Treatment and Drop Forging, pp. 430–432.

*Primary Examiner*—John F. Niebling

*Attorney, Agent, or Firm*—Charles J. Knuth; Peter C. Richardson; Mark Dryer

[57] ABSTRACT

A process for producing a flush edge protected laminate of an inner sheet of a corrodable metal sandwiched between outer sheets of a protective metal which comprises attaching a C-shaped channel of the protective metal over the edge to be protected and rolling the laminate with the attached channel so that the channel is deformed to form a protective edge whose overlapping sides are flush with the upper and lower surfaces of the laminate; and a protected edge bi-metallic laminate prepared by the process.

11 Claims, 8 Drawing Figures

FLUSH EDGE PROTECTED METAL LAMINATES

BACKGROUND OF THE INVENTION

This invention relates to flush edge protected metallic composites in the form of laminates and to a process for producing such protected laminates. Laminates protected in accordance with the process of the invention are particularly suitable as substrates for electrodes to be used in electrolytic cells and the invention is also concerned with an electrode comprising, as a substrate, an edge-protected laminate as herein described.

Bimetallic composites or laminates are known in the art and are generally produced for the purpose of utilizing the characteristics of each of the metal components to enhance the combination. For example, using a core of a light metal sandwiched between layers of a stronger but heavier metal to provide a composite which is substantially lighter than the same volume of the heavy metal alone but considerably stronger than the same volume of the lighter metal alone.

Also, it may be desirable to make a composite of a metal of high thermal or electrical conductivity with another metal of lower conductivity but greater strength to improve the strength characteristics of the composite.

For example the cladding of aluminum or copper with titanium or zirconium has been described in the journal "Metal Treatment and Drop Forging", Sept. 1954, pages 430–432.

United Kingdom Patent No. 996206 discloses a composite product having an aluminium core clad with a strongly bonded outer layer of titanium. This particular composite is produced by a method which comprises heating a core body of alumium to a temperature between 700° F. and 1050° F.; placing a sheet of titanium at ambient temperature in face-to-face contact with said heated core body of aluminum; and immediately passing said sheet of titanium and said aluminium core body conjointly through a rolling mill to obtain a reduction in thickness of said core body of aluminium of between 30% and 80% in one pass.

The reason for conducting the method with a cold titanium outer layer is to avoid oxidation of the titanium. However, problems may arise due to buckling or distortion of the titanium.

Such problems are overcome by the process disclosed is U.S. Pat. No. 3,711,937 issued Jan. 23, 1973 to Emley which process comprises preheating an aluminium sheet and a titanium sheet to a temperature of from about 500° to 1000° F., after cleaning and removing oxide from the surfaces to be bonded, bringing the cleaned, heated surfaces into momentary contact under a rolling pressure sufficient to unite the surfaces and to effect a reduction of the resultant composite sheet amounting to about 3 to 50 per cent and post-heating said composite sheet at a temperature of from about 500° to 1150° F. to develop the bond.

Metal composites such as those described above are useful in applications where the light weight and high electrical and thermal conductivity of the aluminum core coupled with the corrosion resistance and strength of the titanium cladding are advantageous. Thus products made from titanium-clad aluminum find their major applications in electrochemical processing, as heat exchanges and boilers, as cryogenic containers and in structural applications in the aircraft and aerospace industries.

In most of the aforesaid applications any deleterious effect from the environment, for example, excessive corrosion, on the core metal, for example aluminum, is minimal and it was not considered necessary to provide any edge protection for the metal composite. Alternatively, the composite was used in an assembly where the edges were not exposed.

However, where the environment in which the metal composite is to be used is particularly harmful or corrosive to the core metal, for example an electrolytic cell, it is highly desirable and indeed necessary that the core metal be protected, either by taking steps to avoid exposure of the edges of the composite to the corrosive environment or by providing specific edge protection where exposure of the edges to the environment is unavoidable.

An example of an environment which is corrosive to certain metals, particularly aluminum, is the electrolyte used in an electrolytic cell for the production of an alkali metal chlorate, for example, sodium chlorate. A cell for the production of sodium chlorate is disclosed in U.S. Pat. No. 3,883,406. This cell uses, as an anode, titanium coated with platinum.

U.S. Pat. No. 4,075,077 discloses an electrolytic cell having pairs of spaced perforate cathodes with flat imperforate anodes residing within each pair of cathodes. The cathodes are electrically conductive and preferably are carbon steel. The anodes are electrically conductive, preferably titanium, and are coated with a highly conductive precious metal coating. Other metals of the titanium group, i.e. zirconium, tantalum and hafnium, may be used to fabricate the anode. The precious metal coating may be platinum, a platinum iridium alloy or ruthenium oxide.

U.S. Pat. No. 4,405,418 discloses an electrolytic cell in which the anode is an electrode comprising a titanium substrate and a coating of at least one of the platinum metals or an oxide or oxygen-containing solid solution thereof. The cathode is preferably an electrode made of iron or nickel or comprised of such a metal as the substrate and a coating of nickel rhodanide or Raney nickel applied thereonto.

In each of the electrolytic cells described above the anode is preferably titanium coated with a precious metal such as platinum. While, because of the very corrosive electrolyte used in a typical sodium chlorate electrolytic cell, titanium is a suitable choice for the anode substrate, the poor electrical conductivity of solid titanium required the use of an excessively thick and expensive anode substrate. The necessary coating of a highly conductive precious metal adds to the expense.

To avoid the twin problems of poor electrical conductivity and high expense, particularly in cells requiring a high current density, it has been found that titanium clad aluminum provides an excellent anode substrate. The composite exhibits the corrosion resistance of commercially pure titanium with an electrical conductivity substantially greater than solid titanium due to the aluminum core. It is to be noted that, because of the great affinity of titanium for oxygen, to avoid build-up of non-conductive titanium oxide, it is still necessary to coat the composite with a highly conductive precious metal for efficient operation as an anode, but nevertheless a considerable economic saving is realized by using the composite.

However, use of a titamium clad aluminum composite as the anode in an electrolytic cell as described above results in another problem. The aluminum core is highly susceptible to the very corrosive electrolyte. While the upper and lower surfaces of the composite or laminate are adequately protected from corrosion by the corrosion-resistant titanium cladding, at the edges of the composite, where the core is exposed, the aluminum core is unprotected and thereby subject to rapid corrosion. Accordingly, it is necessary to protect the exposed portions of the core by providing appropriate edge protection, preferably formed from the same protective metal, e.g. titanium, as that used for the surface cladding of the laminate.

Additionally it has been found that the mere provision of a capping of protective metal which covers the exposed edge and overlaps the sides of the laminate results in inefficient operation of the cell. It is necessary that the edge protection be flush with the surface of the laminate.

SUMMARY OF THE INVENTION

Accordingly, the present invention provides a process for producing a flush edge protected laminate of an inner sheet of a corrodable metal sandwiched between outer sheets of a protective metal, which comprises forming a C-shaped channel of the protective metal having an inside dimension substantially equal to the thickness of the laminate to be protected, placing said C-shaped channel over the edge to be protected and attaching it to the upper and lower surfaces of the laminate and rolling the laminate with the attached channel at a temperature from room temperature to 1000° F. (538° C.) in a rolling mill set to the gauge of the laminate, thereby deforming the channel and underlying portion of the laminate to result in a protective edge whose overlapping sides are flush with the upper and lower surfaces of the laminate.

The present invention also provides a bimetallic laminate having one or more of its edges protected by a protective edge produced by a process as described above.

Preferably, the inner sheet of corrodable metal of the laminate is aluminum and the protective metal of the outer sheet and the channel is titanium. For example, the laminate to be provided with edge protection in accordance with the present invention may be a titanium clad aluminum composite prepared in accordance with the process disclosed in U.S. Pat. No. 3,711,937. The invention will be particularly described hereafter with reference to the preferred embodiment wherein the corrodable metal is aluminum and the protective metal is titanium. However, it is to be understood that the invention is equally applicable for the provision of edge protection to other metal composites, including, but not restricted to, the following:

titanium/copper/titanium;
nickel/aluminum/nickel;
nickel/copper/nickel;
stainless steel/aluminum/stainless steel;
stainless steel/copper/stainless steel;
carbon steel/aluminum/carbon steel;
carbon steel/copper/carbon steel;
titanium/nickel/titanium
titanium/stainless steel/titanium;
titanium/carbon steel/titanium;
copper/aluminum/copper.

In a preferred embodiment of the process according to the invention the channel of protective metal, e.g. titanium, is attached to the upper and lower surfaces of the laminate by resistance seam welding. A typical procedure for resistance seam welding is described hereinafter and illustrated schematically in the accompanying drawings.

Although resistance seam welding is preferred, any other form of welding or bonding may be used for the attachment of the channel to the laminate.

Although not essential it is also preferred that the thickness of the protective metal forming the C-shaped channel is substantially equal to the thickness of the protective metal layer on each side of the laminate.

When the corrodable metal is aluminum and the protective metal is titanium, a particularly preferred embodiment of the invention in one in which the laminate has a total thickness of from 0.1875 to 0.250 inch (0.476 to 0.635 cm), the titanium outer sheet has a thickness from 0.015 to 0.035 inch (0.038 to 0.089 cm) and the titanium channel has a thickness of 0.017 to 0.035 inch (0.043 to 0.089 cm).

A laminate provided with edge protection in accordance with the process of the invention as described above is suitable, inter alia, for use as a substrate for an electrode in an electrolytic cell and, for such application, the laminate is preferably in the form of a substantially flat plate and said edge protection is applied to at least those edges of the plate which are immersed in the electrolyte.

The actual configuration of the plate electrode is not critical and is generally chosen to conform with the requirements of the cell in which it is to be used. Thus, while the plate may be substantially square or rectangular, in which case the edge protection normally should be provided on three sides, it alternatively may be paddle-shaped as illustrated in the accompanying drawings or any other shape consistent with the design of the cell.

As indicated previously, a titanium-clad laminate has to be further coated with a thin layer of a highly conductive precious metal, such as platinum, to enable it to function efficiently as an anode in an electrolytic cell. This further treatment of the titanium outer layer may be performed in any manner conventional in the art and forms no part of the present invention.

Thus, the present invention further provides an electrode for an electrolytic cell comprising as a substrate, a laminate, preferably a titanium/aluminum/titanium laminate, as described above, in the form of a substantially flat plate provided with edge protection according to the invention on at least the immersed edges.

The electrode preferably is adapted for use as an anode in an electrolytic cell for the production of sodium chlorate. Normally, in such a cell the edge protected titanium-clad aluminum laminate is used only for the anode. Carbon steel is the normal material for the cathode, although other materials may be used.

Even thought the titanium clad laminate provided with edge protection according to the invention is the substrate only and still requires coating with a precious metal before it becomes the completed electrode, the final electrode based upon the titanium/aluminum composite is still less expensive than the prior art solid titanium electrodes. Moreover, the much greater electrical conductivity of the aluminum means that the aluminum-core electrodes are vastly superior to those of solid titanium. The greater electrical conductivity results in reduced power losses (less $i^2R$ heating) and allows use of larger anodes or use of anodes of the same size at higher power levels.

The greater thermal conductivity of the aluminum also tends to reduce the need to cool the electrolyte.

BRIEF DESCRIPTION OF THE DRAWINGS

The invention will now be more particularly described with reference to a preferred embodiment comprising a titanium clad aluminum laminate with flush edge protection. The said embodiment and a schematic representation of its production is illustrated in the accompanying drawings, in which.

DETAILED DESCRIPTION OF THE PREFERRED EMBODIMENT

Figure 1:
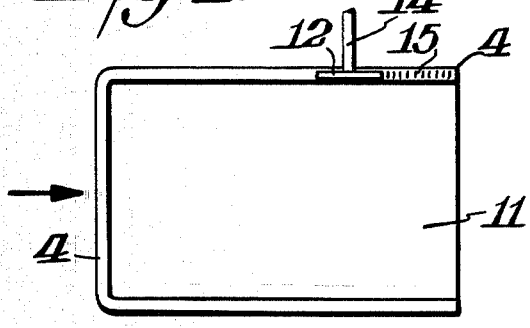
FIG. 1 is a top plan view illustrating schematically the attachment of the channel to the laminate by resistance seam welding.
Figure 2:
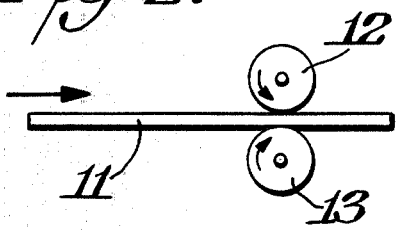
FIG. 2 is a side elevation illustrating the procedure of FIG. 1.

Referring to the accompanying drawings, FIG. 1 and FIG. 2 schematically illustrate the preferred procedure by which the channel of protective metal, e.g. titanium, is attached to the base laminate.

Figure 5:
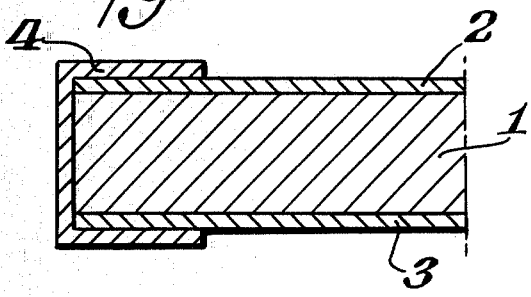
FIG. 5 is a side enlarged cross-section through the channel and laminate before rolling, i.e. taken along line 5—5 of FIG. 3.
Figure 6:
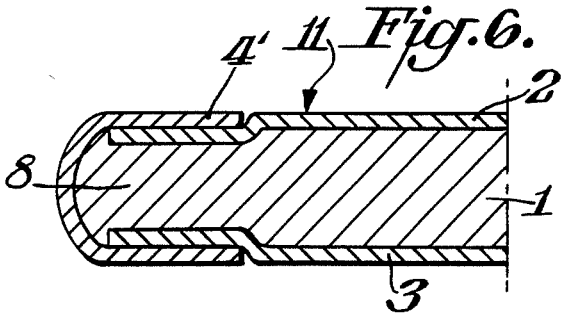
FIG. 6 is a side enlarged cross-section through the channel and laminate after rolling, i.e. taken along line 6—6 of FIG. 3 and FIG. 7.

FIG. 1 illustrates a laminate 11 comprising a core of aluminum 1 between a top layer 2 and a bottom layer 3 of titanium (see FIGS. 5 and 6). The laminate 11 is in the form of a substantially rectangular plate around three sides of which is placed a channel 4 of titanium.

The channel is made from a strip of titanium sheet, preferably of substantially the same thickness as the protective layer on the laminate, and the channel shape (see the cross section in FIG. 5) is formed by press braking or roll forming according to conventional techniques. The channel so formed has an inside dimension substantially equivalent to the gauge of the laminate. The inside surface of the channel and the upper and lower surfaces of the laminate are stainless steel brushed to provide clean welding surfaces. The channel is then cold formed in a hydraulic die to fit the outside periphery of the laminate.

The channel is attached to the laminate by resistance seam welding using a top electrode roller 12 rotatably attached to a shaft 14 and a bottom electrode roller 13 (FIG. 2) also rotatably attached to a shaft (not shown). The channel and laminate are passed between the electrode rollers, which are rotating in the direction of the arrows, and the rollers transmit the current and also the mechanical pressure required for producing a welded seam, 15.

Figure 3:
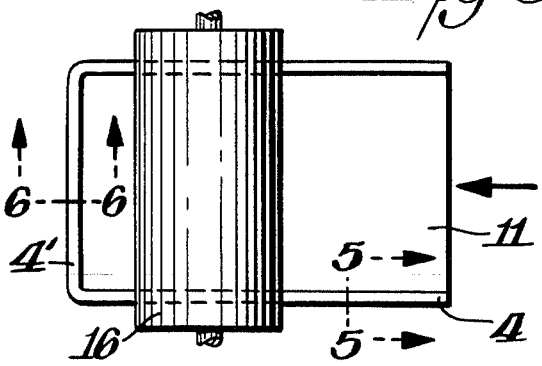
FIG. 3 is a top plan view illustrating schematically the step of rolling to make the channel flush with the laminate.
Figure 4:
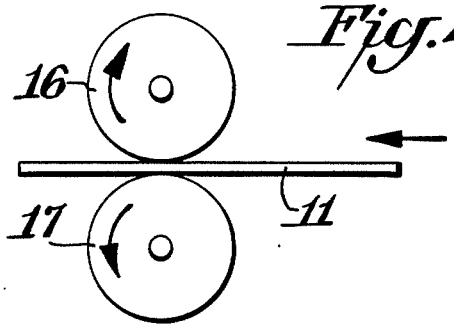
FIG. 4 is a side elevation illustrating the rolling step of FIG. 3.

FIGS. 3 and 4 schematically illustrate the passage of the laminate with the attached channel through the rollers 16, 17 of a rolling mill. The rolling may be conducted at a temperature from room temperature to 1000° F. (538° C.), but it is preferred that the laminate/-channel composite be pre-heated to a temperature of about 900° F. (482° C.) before passage through the rollers. The rollers 16, 17 are set to the gauge of the laminate and either end of the laminate may be fed through the rollers. In the embodiment illustrated in FIG. 3 the laminate is fed through the rollers in the direction of the arrow. Prior to passage throught the rollers the overlapping sides of the channel 4 are raised with respect to the surface of the laminate as shown in FIG. 5. Passage through the rollers deforms the channel and the underlying portion of the laminate so that, on emergence from the rollers, the deformed channel 4' is flush with the upper and lower surfaces of the laminate as shown in FIG. 6.

The portion of the laminate underlying the channel also undergoes deformation by the rolling step and the profile 8 illustrated in FIG. 6 has been verified by photomicrographs.

Figure 7:
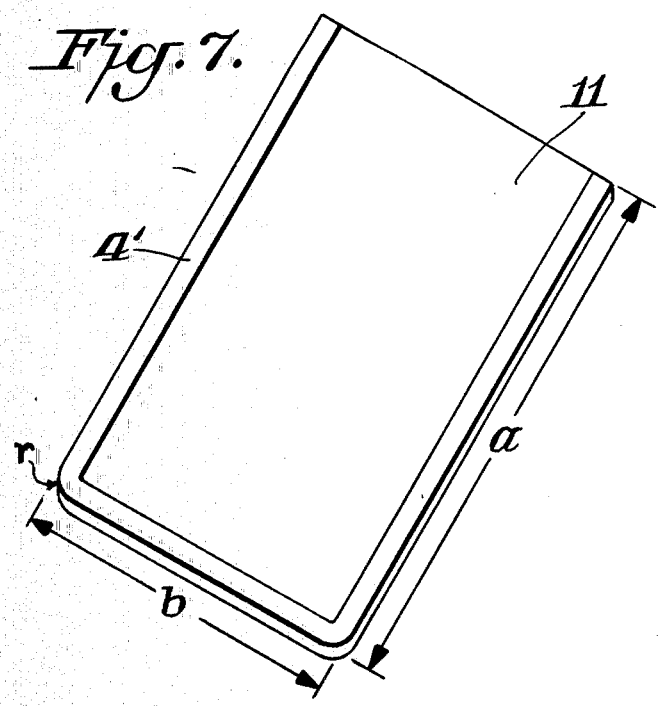
FIG. 7 is a perspective view of a laminate with flush edge protection according to the invention in the form of a substantially rectangular flat plate with edge protection on three sides.

FIG. 7 illustrates a laminate 11 in the form of a flat rectangular plate provided with flush edge protection 4' on three sides; said edge protection having been applied by the procedures illustrated in FIGS. 1 to 4 as described above.

The plate illustrated in FIG. 7 is suitable for use as the substrate for an anode in a sodium chlorate electrolytic cell. Typical dimensions for such a plate are:

length, a: from 35 to 44 inches (88.90 to 111.76 cm.)

width, b: from 19 to 21 inches (48.26 to 53.34 cm.) radius of curvature, r: about 1 inch (2.54 cm.)

total thickness: from 0.1875 to 0.250 inch (0.476 to 0.635 cm.)

thickness of protective metal (titanium): 0.015 to 0.035 inch (0.038 to 0.089 cm.)

Figure 8:
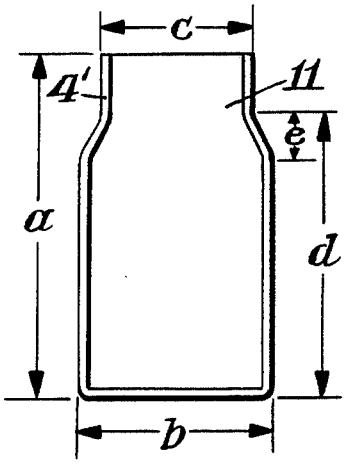
FIG. 8 is a reduced plan view of an embodiment having a "paddle" shape.

FIG. 8 illustrates an alternative "paddle" shape for a plate having edge protection in accordance with the invention. In such a "paddle" shaped plate the overall length, a, and width, b, may be the same as for the rectangular plate of FIG. 7. The other typical dimensions are:

upper width, c: from 16 to 17 inches (40.64 to 43.18 cm.)

paddle depth, d: from 30 to 39 inches (76.20 to 99.06 cm.)

inversion depth, e: from 5.5 to 6.5 inches (13.97 to 16.51 cm.)

The following Example illustrates the invention and the manner in which it may be performed.

EXAMPLE

A. Preparation of Materials

Grade 1 (low iron) titanium sheet of thickness 0.032 inch (0.081 cm.) was preformed on a press brake into a channel having an internal dimension of 0.1875 inch (0.476 cm.)

The channel was cut to the length required to go round three sides of a chosen rectangular laminate and bent into shape.

The preformed channel was then annealed for a sufficient time and temperature to remove forming lubricant.

The inside of the channel was brushed with a stainless steel wire brush to remove oxidation product in the channel.

A rectangular plate of a titanium/aluminum/titanium laminate having a gauge of 0.1875 inch (0.476 cm.) with grade 1 (low iron) titanium cladding of 0.030 inch (0.076 cm) thickness was cleaned for welding by brushing the edges with a stainless steel wire brush. Care was taken to avoid handling the the brushed edges; unless cotton gloves were worn to avoid fingerprints.

B. Assembly

The channel was placed around the cleaned plate and the assembly fitted into a specially fabricated frame.

The channel was then attached to the plate by resistance seam welding using the following welding parameters:

Intermittant welding mode;

Current Settings:

Taylor Winfield Setting of P2 Tap 8

Technitron setting of 100%.

Heat time 3.

Cool time 3.

Welding force 300 lbs.

Welding speed 3.3 f.p.m. (dependent on the diameter of the welding rollers).

The welding rollers are 0.375 inch (0.952 cm) wide and have a radius of 3 inches (7.62 cm.) and are machined on the face.

During operation the rollers should be inspected daily for embedded aluminum, severe nicks or mushrooming. If any of these conditions are present the rollers should be changed.

When the channel is welded to the plate the seam weld may be tested by submerging the plate in a tank of water. Air at a pressure of 5 p.s.i.g. is then blown into the gap between the channel and the plate and examination is made for bubbles which would indicate a leak.

The plate should be tested with both sides up and with air forced through both ends of the channel. If any additional operations are preformed, e.g. flattening, the plates should be rechecked.

If any leaks are discovered the seam may be repaired by rewelding using the welding parameters set out above.

C. Rolling step

The seam welded laminate/channel composite prepared as above was heated in an oven at a temperature of 900° F. (482° C.) for 12 minutes. The heated composite was then passed through a rolling mill with the rollers set to a gauge of 0.1875 inch (0.476 cm.). The resulting rolled plate was completely flush across its entire surface.

The plate prepared in accordance with the above Example was found to be particularly suitable for use as the substrate for an anode in a sodium chlorate electrolytic cell.

Anodes prepared from plates made in accordance with the present invention realize substantial economic savings as compared, for example, with the solid titanium plates used in prior art electrolytic cells. The actual operation of the cell for the production of sodium chlorate may be conducted according to know procedures and is not part of the present invention.

Plates made in accordance with the present invention, including those made from metal composites other than titanium/aluminum/titanium, are also useful for other applications where flush edge protection is necessary or desirable, for example in the aircraft and aerospace industries.

We claim:

1. A process for producing a flush edge protected laminate adapted to be used as a substrate for an electrode in an electrolytic cell and comprising an inner sheet of a corrodable metal sandwiched between outer sheets of a protective metal, which comprises forming a C-shaped channel of the protective metal having an inside dimension substantially equal to the thickness of the laminate to be protected, placing said C-shaped channel over the edge to be protected and attaching at to the upper and lower surfaces of the laminate and rolling the laminate with the attached channel at a temperature from room temperature to 1000° F. (538° C.) in a rolling mill set to the gauge of the laminate, thereby deforming the channel and underlying portion of the laminate to result in a protective edge whose overlapping sides are flush with the upper and lower surfaces of the laminate.

2. A process according to claim 1, in which the channel is attached to the upper and lower surfaces of the laminate by resistance seam welding.

3. A process according to claim 1, in which the thickness of the protective metal forming the C-shaped channel is substantially equal to the thickness of the protective metal layer on each side of the laminate.

4. A process according to claim 1, in which the inner sheet of corrodable metal of the laminate is aluminum and the protective metal of the outer sheet and the channel is titanium.

5. A process according to claim 4, in which the laminate has a total thickness of from 0.1875 to 0.250 inch (0.476 to 0.635 cm.), the titanium outer sheet has a thickness from 0.015 to 0.035 inch (0.038 to 0.089 cm.) and the titanium channel has a thickness of 0.017 to 0.035 inch (0.043 to 0.089 cm.).

6. A process according to claim 4, in which the resulting laminate is a substantially flat plate adapted to be used as a substrate for an electrode in an electroyltic cell and said edge protection is applied to at least the immersed edges of the plate to prevent the aluminum core from coming into contact with the electrolyte.

7. A bimetallic laminate having one or more of its edges protected by a protective edge produced by a process according to claim 1.

8. An edge-protected laminate according to claim 7, in which the corrodable metal is aluminum and the protective metal is titanium.

9. A laminate according to claim 8 in which the total thickness is from 0.1875 to 0.250 inch (0.476 to 0.635 cm.) and the thickness of the protective metal is from 0.015 to 0.035 inch (0.038 to 0.089 cm.).

10. An electrode for an electrolytic cell comprising as a substrate a laminate according to claim 8 in the form of a substantially flat plate provided with said edge protection on at least the immersed edges.

11. An electrode according to claim 10 for use in an electrolytic cell for the production of sodium chlorate.

* * * * *